US012281424B2

(12) United States Patent
Bamba et al.

(10) Patent No.: US 12,281,424 B2
(45) Date of Patent: Apr. 22, 2025

(54) NEEDLE-THREADING DEVICE FOR SEWING MACHINE AND SEWING MACHINE EQUIPPED WITH SAID DEVICE

(71) Applicant: JANOME Corporation, Hachioji (JP)

(72) Inventors: Yoshitaka Bamba, Hachioji (JP); Tomoro Mifuji, Hachioji (JP)

(73) Assignee: JANOME CORPORATION, Tokyo (JP)

( * ) Notice: Subject to any disclaimer, the term of this patent is extended or adjusted under 35 U.S.C. 154(b) by 0 days.

(21) Appl. No.: 18/554,907

(22) PCT Filed: Mar. 18, 2022

(86) PCT No.: PCT/JP2022/012649
§ 371 (c)(1),
(2) Date: Oct. 11, 2023

(87) PCT Pub. No.: WO2022/220016
PCT Pub. Date: Oct. 20, 2022

(65) Prior Publication Data

US 2024/0200250 A1 Jun. 20, 2024

(30) Foreign Application Priority Data

Apr. 14, 2021 (JP) ..... 2021-068566

(51) Int. Cl.
*D05B 87/02* (2006.01)

(52) U.S. Cl.
CPC ..... *D05B 87/02* (2013.01)

(58) Field of Classification Search
CPC ..... D05B 87/00; D05B 87/02
See application file for complete search history.

(56) References Cited

U.S. PATENT DOCUMENTS 5,072,678 A * 12/1991 Satoma ..... D05B 87/02 112/225
5,195,452 A * 3/1993 Kamiya ..... D05B 87/02 112/225
2009/0013912 A1* 1/2009 Miyoshi ..... D05B 87/02 112/225

FOREIGN PATENT DOCUMENTS

JP H05-007683 A 1/1993
JP H10-099581 A 4/1998
JP 2008-295743 A 12/2008

OTHER PUBLICATIONS

English Translation of International Search Report dated May 24, 2022, issued in counterpart Application No. PCT/JP2022/012649. (2 pages).

(Continued)

*Primary Examiner* — Nathan E Durham
(74) *Attorney, Agent, or Firm* — WHDA, LLP

(57) ABSTRACT

The needle-threading device includes a needle-threading shaft that is parallel to a vertically-moving needle bar and that is vertically movable and rotatable, a control lever that lowers and rotates the needle-threading shaft, a needle-threading end section provided at a lower end of the needle-threading shaft and having a needle-threading hook, and a needle-threading stopper provided at the needle bar and defining a lowered stoppage position of the needle-threading shaft. The needle-threading end section lowered by operating the control lever rotates at the lowered stoppage position and causes the needle-threading hook to be inserted through a needle hole of one needle of a plurality of needles provided at the needle bar. The needle-threading end section includes a sliding body that vertically moves relative to the needle-threading shaft, a positioning body slidable relative to the (Continued)

sliding body, and an interlocking mechanism that vertically moves the sliding body.

11 Claims, 6 Drawing Sheets

(56) References Cited

OTHER PUBLICATIONS

Office Action dated Jul. 11, 2023, issued in counterpart TW Application No. 111110044. (4 pages).

* cited by examiner

UP (Z)
LEFT (Y)
RIGHT (Y)
DOWN (Z)

L POSITION
M POSITION
R POSITION
h1+h2
S
θ
δ
40
41
42
43
44
46
47
50
51
52
53
54
54a
54b
54c
55
13
31

NEEDLE-THREADING DEVICE FOR SEWING MACHINE AND SEWING MACHINE EQUIPPED WITH SAID DEVICE

TECHNICAL FIELD

The present invention relates to needle-threading devices for threading threads through needle holes in needles of sewing machines, and particularly, to a needle-threading device compliant with multiple needles and for threading each needle in a sewing machine equipped with the multiple needles.

BACKGROUND ART

Sewing machines equipped with needle-threading devices are known in the related art.

A common needle-threading device includes a needle-threading hook for holding a thread, and is provided near a needle driving device of the sewing machine. During needle-threading, the needle-threading device descends in response to lowering of a control lever so that a positioning member comes into contact with the needle driving device, whereby a height position relative to the needle driving device that moves vertically is defined and the needle-threading hook is inserted through a needle hole at a needle tip.

Subsequently, a thread is hooked to the inserted needle-threading hook, and the control lever is restored, so that the needle-threading hook recedes from the needle hole while still holding the thread, whereby the thread is inserted through the needle hole.

In this case, if there is one needle, the needle-threading is completed with the above operation. However, in a sewing machine equipped with multiple needles, the needle-threading also needs to be performed on the remaining one or more needles. Although the multiple needles are arranged evenly in the horizontal direction, the needle holes may vary in height, as shown in FIG. 2, due to the structure of the sewing machine or due to the formation of stitches.

Therefore, it is desirable that a needle-threading device compliant with multiple needles can accurately insert the needle-threading hook through multiple needle hole positions that vary not only in the horizontal direction but also in the height direction.

Therefore, various needle-threading devices compliant with multiple needles have been proposed.

For example, in a proposed needle-threading device for a sewing machine, the positioning member for positioning the needle-threading device and the needle driving device has a multi-stepped shape, so that multiple relative positions of the entire needle-threading device in the left-right direction and the up-down direction relative to the needle driving device can be defined, thereby allowing for threading of multiple needles (see Patent Literature 1).

However, the ability to define multiple relative positions of the entire needle-threading device in the left-right direction and the up-down direction relative to the needle driving device, as in the needle-threading device described in Patent Literature 1, leads to a complex and large-sized device. Thus, there has been proposed another needle-threading device that threads two needles at different heights by allowing only a part of the needle-threading device including the needle-threading hook to slide or rotate relative to the needle-threading device (see Patent Literatures 2 and 3).

CITATION LIST

Patent Literature

PTL 1: Japanese Unexamined Patent Application Publication No. 2008-295743

PTL 2: Japanese Unexamined Patent Application Publication H05-7683

PTL 3: Japanese Unexamined Patent Application Publication H10-99581

SUMMARY OF INVENTION

Technical Problem

The needle-threading device described in each of Patent Literatures 2 and 3 is advantageous in that the device can be simplified and reduced in size, but is problematic in that the number of needles that can be used and the positional relationship thereof are limited.

For example, the needle-threading device described in Patent Literature 2 is not compliant with three or more needles at different heights due to the structure in which the part of the needle-threading device including the needle-threading hook slides linearly relative to the needle-threading device.

The needle-threading device described in Patent Literature 3 is compliant with up to three needles in theory since the part of the needle-threading device including the needle-threading hook rotates relative to the needle-threading device. However, because the rotational center (i.e., a center O of a circular arc E in FIG. 2) during the rotation is determined in accordance with the positional relationship among the needles, the rotational center is not necessarily located on the movement path of the needle-threading device, and it is technically difficult to match the rotational center of the needle-threading device with the center O. In addition, in view of the fact that the angle of the needle-threading hook changes with the rotation, it is technically difficult to actually thread all of the three needles reliably with this structure.

The present invention has been made to solve the problems mentioned above, and an object thereof is to provide a needle-threading device compliant with an arbitrary number of needles attached at arbitrary heights and a sewing machine equipped with the device.

Solution to Problem

In order to solve the aforementioned problems, the present invention provides a needle-threading device for a sewing machine. The needle-threading device includes a needle-threading shaft that is parallel to a vertically-moving needle bar and that is vertically movable and rotatable, a control lever that lowers and rotates the needle-threading shaft, a needle-threading end section provided at a lower end of the needle-threading shaft and having a needle-threading hook, and a needle-threading stopper provided at the needle bar and defining a lowered stoppage position of the needle-threading shaft. The needle-threading end section lowered by operating the control lever rotates at the lowered stoppage position and causes the needle-threading hook to be inserted through a needle hole of one needle of a plurality of needles provided at the needle bar. The needle-threading end section includes a sliding body that vertically moves relative to the needle-threading shaft, a positioning body slidable relative to the sliding body, and an interlocking mechanism that vertically moves the sliding body relative to the needle-threading shaft in accordance with sliding of the positioning body.

As an embodiment of the needle-threading device for the sewing machine according to the present invention, the interlocking mechanism includes a reference pin provided at the needle-threading shaft and a slot cam that is provided in the positioning body and with which the reference pin is in slidably contact. Furthermore, the sliding body includes a switch lever that defines a slide position of the positioning body and a switch spring that retains the slide position of the positioning body by the switch lever, and the positioning body includes a switch cam having a notch that engages with the switch spring. Moreover, the sliding body includes an eccentric pin that adjusts a sliding distance of the positioning body.

Furthermore, a sewing machine according to the present invention includes the aforementioned needle-threading device.

Advantageous Effects of Invention

The needle-threading device for the sewing machine according to the present invention employs the above configuration, so that when the switch lever is manually operated, the needle-threading hook provided at the needle-threading end section of the needle-threading device moves relative to the needle-threading shaft by arbitrary amounts in the left-right direction and the up-down direction, thereby allowing for threading through the needle hole in each needle even in a sewing machine equipped with multiple needles at different height positions.

DESCRIPTION OF EMBODIMENTS

A needle-threading device for a sewing machine according to an embodiment of the present invention will now be described with reference to the drawings indicated in the embodiment.

Figure 1:
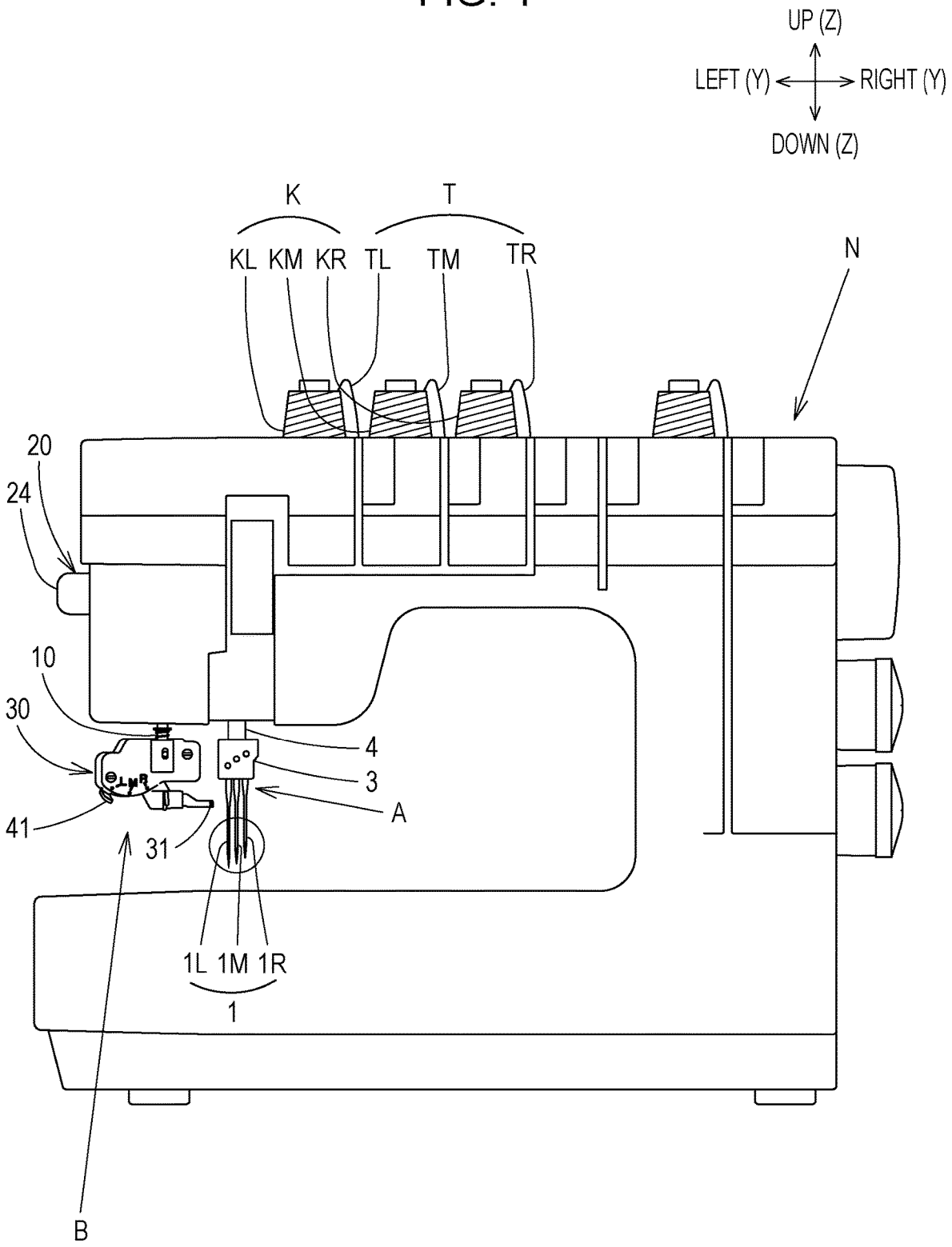
FIG. 1 is a schematic diagram of a sewing machine equipped with a needle-threading device according to an embodiment of the present invention.

Referring to FIG. 1, in the following description, the vertical direction will be defined as "up-down", the horizontal direction will be defined as "left-right", and the direction orthogonal to the plane of the drawing will be defined as "front-rear".

Embodiment

In FIG. 1, A denotes a needle driving device provided at a head portion of a sewing machine N and for vertically moving a needle bar 4 that secures three needles 1 by using a needle clamp 3, and B denotes a needle-threading device for threading a thread T (TL, TM, TR) supplied from a thread spool K (KL, KM, KR) through a needle hole 2 (2L, 2M, 2R, see FIG. 2) in the needle 1 (1L, 1M, 1R) of the needle driving device A.

The needle-threading device B includes a needle-threading shaft 10 that is parallel to the needle bar 4, a control lever 20 that is exposed from the head portion of the sewing machine N and that lowers the needle-threading shaft 10, and a needle-threading end section 30 provided at the lower end of the needle-threading shaft 10.

Figure 2:
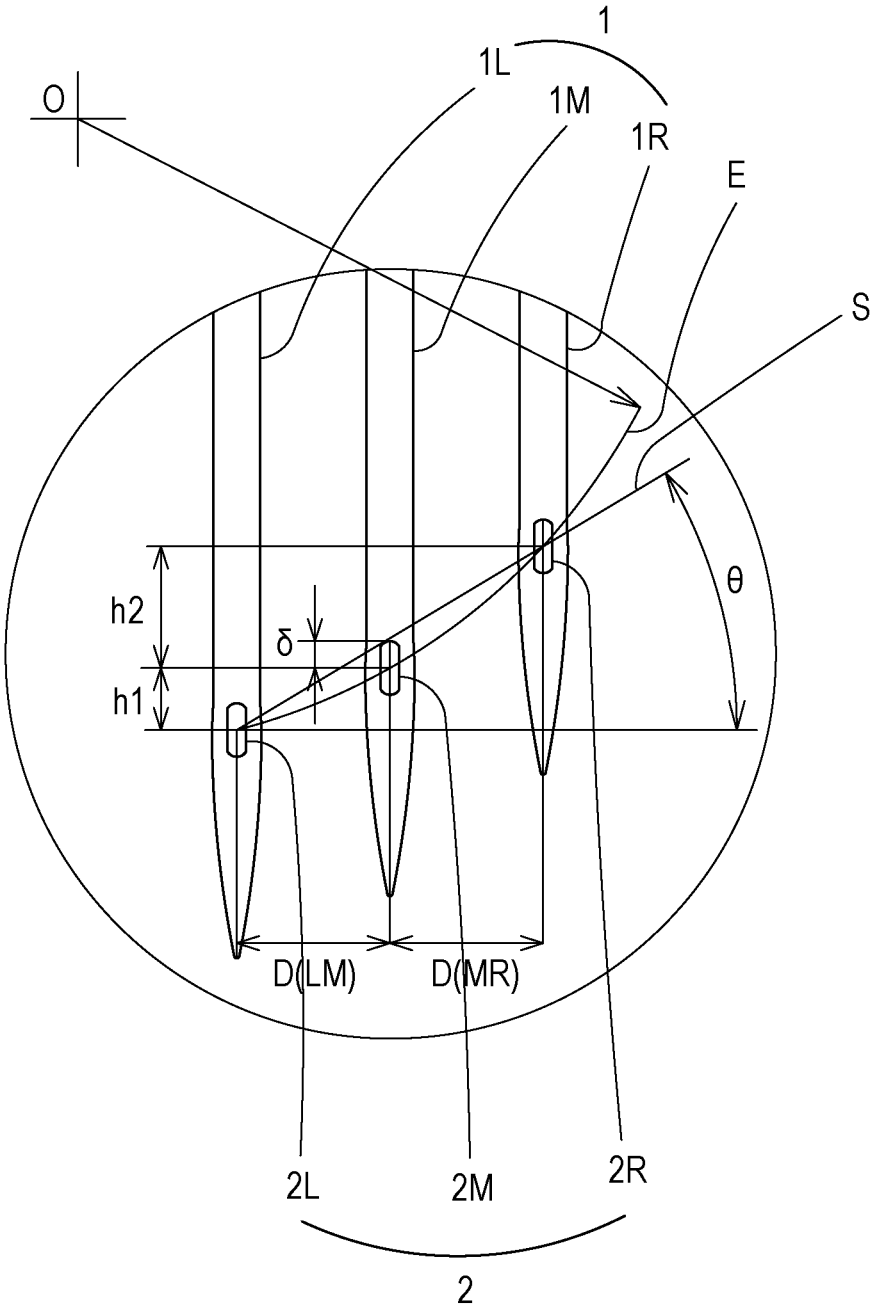
FIG. 2 is an enlarged view illustrating a relevant part of needles in FIG. 1.

As shown in FIG. 2, in this embodiment, the needles 1 of the needle driving device A include three needles 1L, 1M, and 1R provided from left to right at pitches (distances) D (LM) and D (MR) that are equal to each other. With regard to the needle holes 2L, 2M, and 2R of the three needles 1, a height h1 between 2L and 2M and a height h2 between 2M and 2R are different from each other.

Accordingly, since the heights of the needle holes 2 are set such that stitches can be reliably formed in accordance with the mechanism of the sewing machine N and the threads T moving in conjunction with the movement of the needles 1, the height h1 and the height h2 are not equal to each other.

Therefore, although the needle holes 2L, 2M, and 2R can be connected by the circular arc E from the center O, since the height of the needle hole 2M has a vertical positional difference δ with a line S connecting the needle hole 2L and the needle hole 2R to each other, the needle holes 2L, 2M, and 2R cannot be connected by the line S having an angle of κ from a horizontal line.

Although this embodiment is described with reference to an example where the needles 1 are the three needles 1L, 1M, and 1R with the needle holes 2 at different heights, the needles 1 may be four or more needles at different heights.

Figure 3:
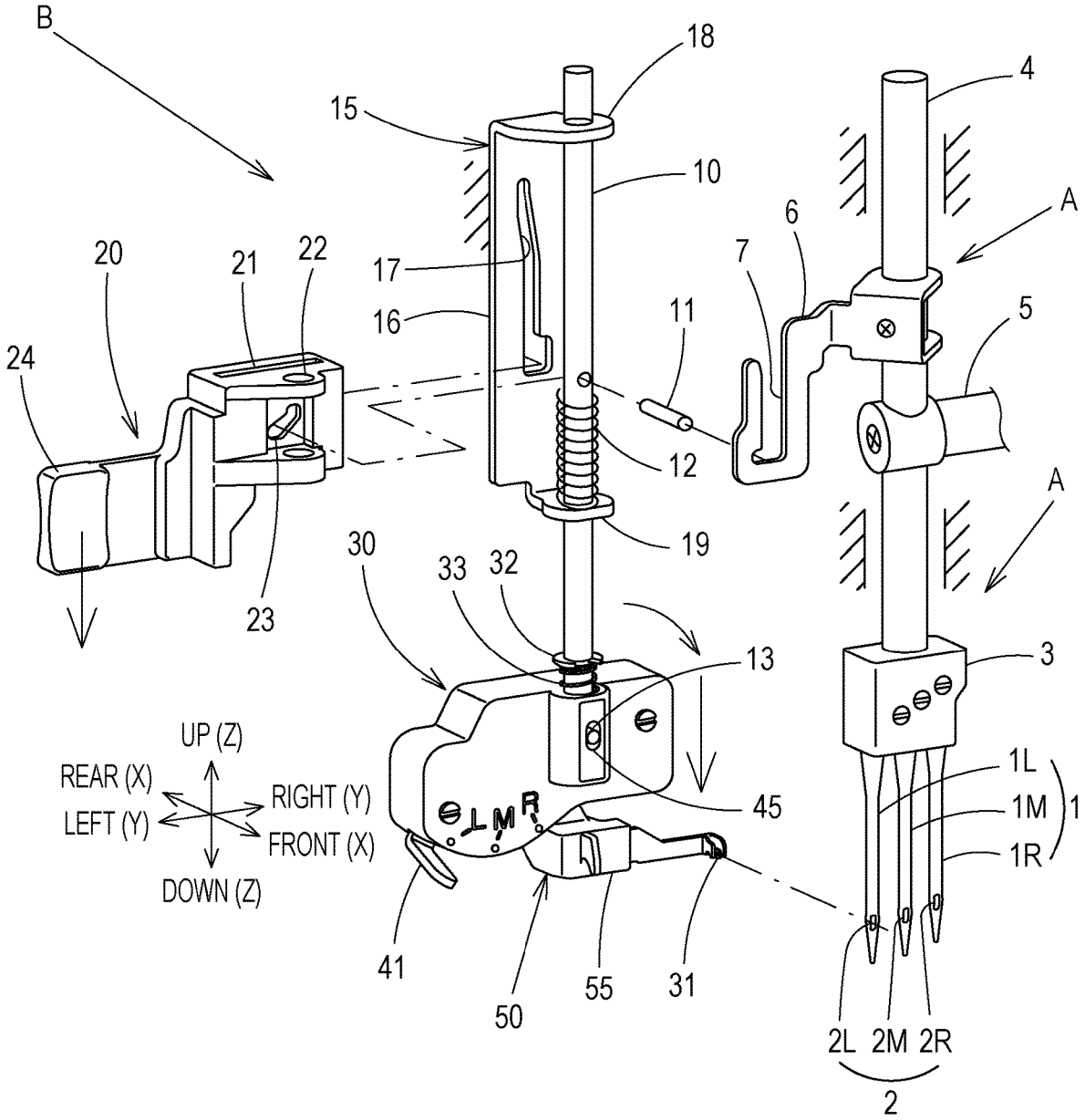
FIG. 3 is a schematic diagram illustrating the structure of a needle driving device and the needle-threading device according to the embodiment of the present invention.

As shown in FIG. 3, the needle driving device A includes the needle bar 4 to which the three needles 1 of 1L, 1M, and 1R are secured by using the needle clamp 3, a needle-bar connecting bracket 5 that is connected to the needle bar 4 and that is vertically driven by a needle vertically-driving mechanism (not shown), and a needle-threading stopper 6 that is secured to the needle bar 4 and that defines a lowered stoppage position of the needle-threading shaft 10 provided in the needle-threading device B to be described below. The needle-threading stopper 6 has a stopper slot 7 recessed from above.

As shown in FIG. 3, the needle-threading device B includes the needle-threading shaft 10 that is parallel to the needle bar 4 and that is supported in a vertically-movable and rotatable manner by a needle-threading-shaft support plate 15, the control lever 20 that is supported in a vertically-movable manner along the needle-threading-shaft support plate 15 and that lowers and rotates the needle-threading shaft 10, and the needle-threading end section 30 provided at the lower end of the needle-threading shaft 10 and having a needle-threading hook 31.

A midpoint of the needle-threading shaft 10 is provided with a stopper pin 11 that can be brought into abutment with the lower end of the stopper slot 7 of the needle-threading stopper 6.

The needle-threading-shaft support plate 15 is secured to a frame of the sewing machine N, is provided with a needle-threading-shaft slot 17 extending in the up-down direction of a rear surface plate 16, is provided with an upper bearing 18 at the upper end, and is provided with a lower bearing 19 at the lower end.

The needle-threading shaft 10 is fitted in the upper bearing 18 and the lower bearing 19 of the needle-threading-shaft support plate 15. The rear side of the stopper pin 11 is fitted in the needle-threading-shaft slot 17 of the needle-threading-shaft support plate 15. A needle-threading return spring 12 is disposed between the stopper pin 11 of the needle-threading shaft 10 and the lower bearing 19 and biases the stopper pin 11 upward to bring the stopper pin 11 into abutment with the upper end of the needle-threading-shaft slot 17.

The control lever 20 includes a support-plate slide hole 21 in which the rear surface plate 16 of the needle-threading-shaft support plate 15 is fitted in the up-down direction and that is split into front and rear portions, although not shown, a shaft hole 22 in which the needle-threading shaft 10 is fitted in the up-down direction, a needle-threading-shaft rotating cam 23 that is provided to extend across the support-plate slide hole 21 and that engages with the stopper pin 11, and a knob 24 exposed from the head portion of the sewing machine N, as shown in FIG. 1.

Figure 4:
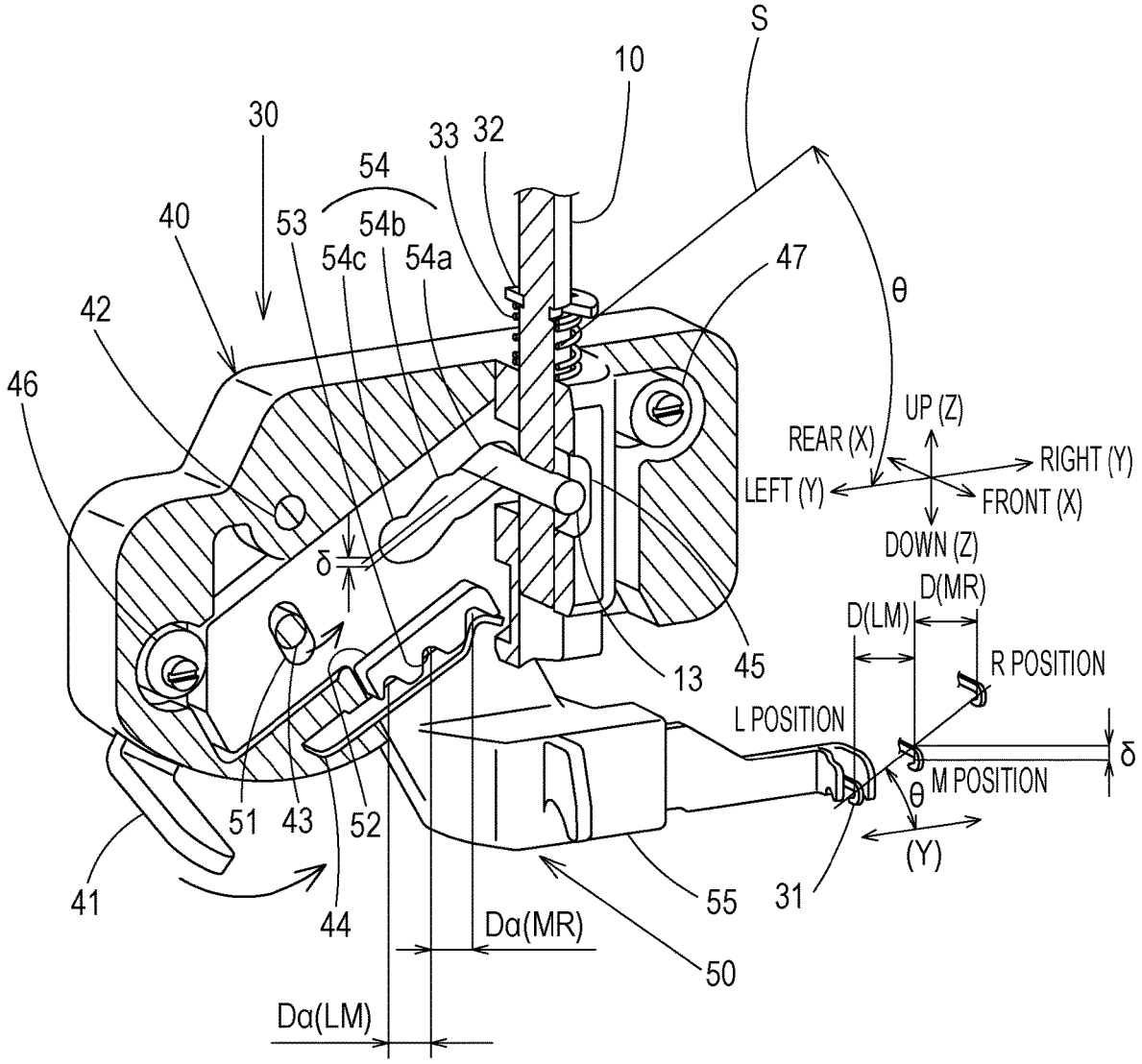
FIG. 4 is a diagram illustrating the internal structure of a needle-threading end section of the needle-threading device according to the embodiment of the present invention.

As shown in FIGS. 3 and 4, the needle-threading end section 30 includes a sliding body 40 that moves vertically relative to the needle-threading shaft 10 and that is split into front and rear portions, although not shown, and a positioning body 50 slidable relative to the sliding body 40 in the direction in which the needles 1 are arranged. The positioning body 50 is provided with the needle-threading hook 31 with a hook arm 55 interposed therebetween.

The sliding body 40 includes a reference-pin slide long hole 45 and slides relative to a reference pin 13 secured to a lower portion of the needle-threading shaft 10. For biasing the sliding body 40 downward, the needle-threading shaft 10 is provided with a pressure spring 33 between an E-shaped snap ring 32, which is secured to the needle-threading shaft 10, and the sliding body 40.

The sliding body 40 includes a switch lever 41 that defines a slide position of the positioning body 50. The switch lever 41 has an action pin 43 that pivots about a fulcrum pin 42 pivotally attached to the sliding body 40. When the switch lever 41 is operated in the direction of an arrow in response to the action pin 43 engaging with an action-pin slide long hole 51 provided in the positioning body 50, the positioning body 50 slides relative to the sliding body 40 in the direction of the line S having the angle of θ from the horizontal line.

As shown in FIGS. 1 and 3, "L", "M", and "R" corresponding to the three needles 1L, 1M, and 1R are indicated as switch positions of the switch lever 41 on the surface of the sliding body 40 (needle-threading end section 30).

The positioning body 50 includes a switch cam 52 having three notches (recesses) 53 at the same distances as the pitches D (LM) and D (MR) of the three needles 1 in the sliding direction. The notches 53 in the switch cam 52 engage with a switch spring 44 provided at the sliding body 40 so that the positioning body 50 is retained at the slide positions corresponding to the three needles 1L, 1M, and 1R by the switch lever 41.

Furthermore, the positioning body 50 includes the reference pin 13 secured to the needle-threading shaft 10 and a slot cam 54 with which the reference pin 13 is in slidably contact. The reference pin 13 and the slot cam 54 serve as an interlocking mechanism that vertically moves the sliding body 40 relative to the needle-threading shaft 10 in accordance with the slide positions corresponding to the three needles 1L, 1M, and 1R by the switch lever 41.

The slot cam 54 has a stepped shape having an L surface 54*a*, an M surface 54*b*, and an R surface 54*c* as three stepped cam surfaces corresponding to the heights of the needle holes 2L, 2M, and 2R.

The pressure spring 33 biasing the sliding body 40 is provided for preventing looseness between the reference pin 13 and the slot cam 54, and is omittable.

In this embodiment, distances Da (LM) and Da (MR) between the notches 53 in the switch cam 52 are set to be greater than the pitches D (LM) and D (MR) of the actual needles 1. By rotating an L adjustment pin 46 and an R adjustment pin 47 serving as eccentric pins, D (LM) and D (MR) serving as the sliding distances of the positioning body 50 can be adjusted, thereby coping with variations in the pitches of the needles 1.

Next, the usage and the advantageous effects of this embodiment will be described.

Figure 6:
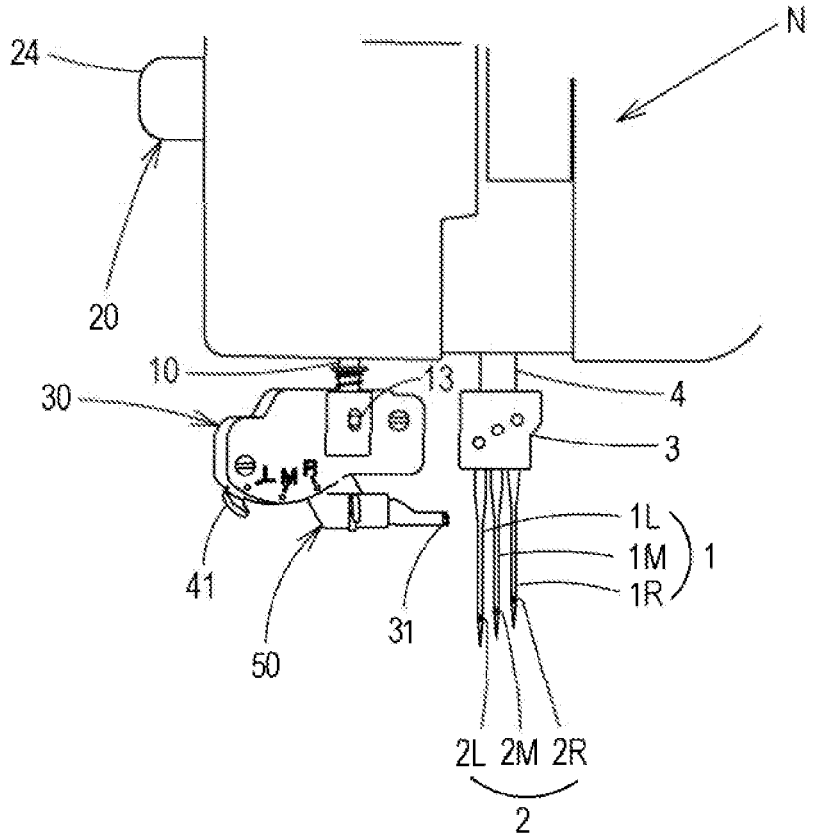
FIG. 6 includes schematic diagrams illustrating the operation of the needle-threading device according to the embodiment of the present invention, and includes a front view (a) illustrating a standby mode and a front view (b) illustrating a needle-threading mode.
Figure 6:
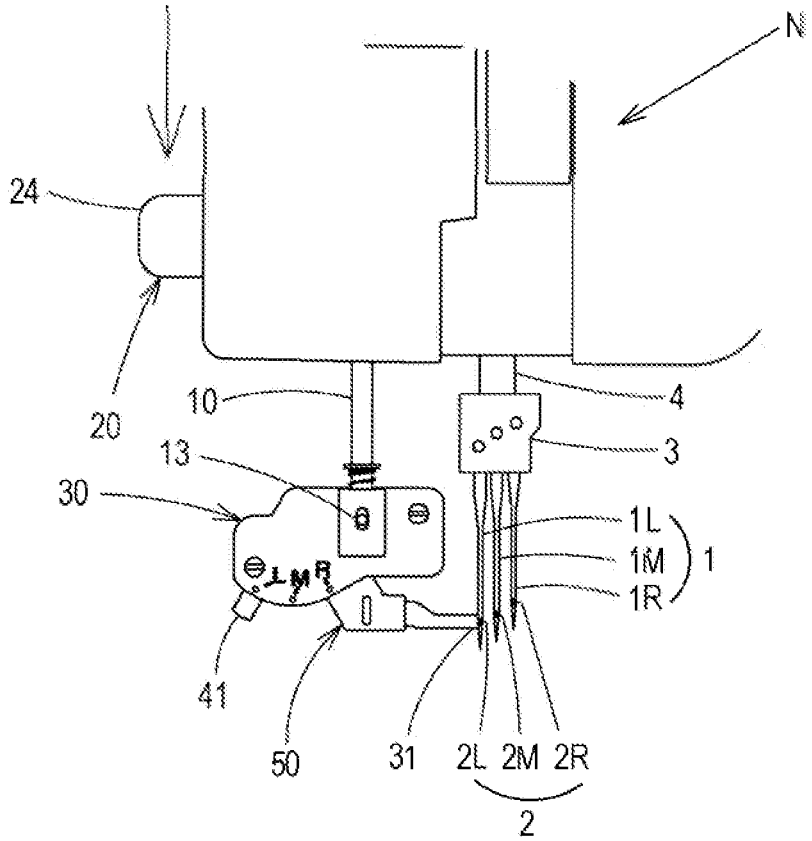

In order to thread the threads TL, TM, and TR through the needle holes 2L, 2M, and 2R in the three needles 1 by using the needle-threading device B according to this embodiment, the switch lever 41 is first manually set to the position "L" indicated on the surface of the sliding body 40 in a standby mode shown in FIG. 1 and FIG. 6(*a*).

Figure 5:
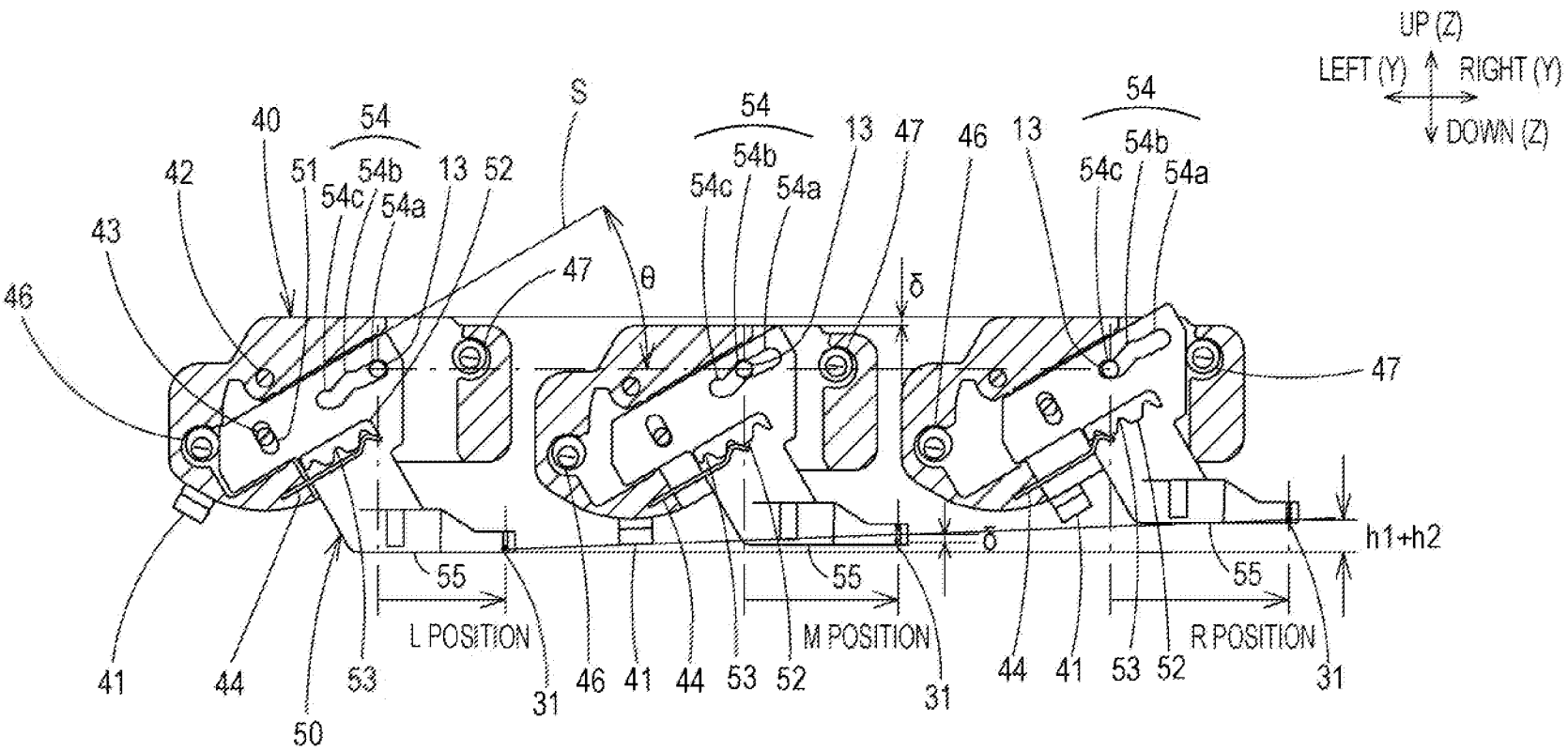
FIG. 5 includes diagrams illustrating the positioning of a needle-threading hook relative to a needle-threading shaft (reference pin) of the needle-threading device according to the embodiment of the present invention, and includes a diagram (a) illustrating a positioned state in a needle hole 2L, a diagram (b) illustrating a positioned state in a needle hole 2M, and a diagram (c) illustrating a positioned state in a needle hole 2R.

Then, as shown in FIG. 5(*a*), the left end of the positioning body 50 comes into abutment with the L adjustment pin 46, the right notch 53 of the switch cam 52 engages with the switch spring 44 provided at the sliding body 40, and the reference pin 13 comes into slidably contact with the L surface 54*a* of the slot cam 54, whereby the slide position of the positioning body 50 is defined such that the needle-threading hook 31 corresponds to the position (L position) of the needle hole 2L in the needle 1L.

Then, when the knob 24 of the control lever 20 exposed from the head portion of the sewing machine N is pressed down from the state shown in FIG. 6(*a*), the needle-threading shaft 10 descends and causes the stopper pin 11 shown in FIG. 3 to come into contact with the lower end of the stopper slot 7 of the needle-threading stopper 6, whereby the vertical positions of the needle driving device A and the needle-threading device B are defined.

Furthermore, the stopper pin 11 is also fitted in the needle-threading-shaft slot 17 and the needle-threading-shaft rotating cam 23. When the knob 24 of the control lever 20 is further pressed down after the stopper pin 11 comes into contact with the lower end of the stopper slot 7, the needle-threading shaft 10 is rotated in the direction of the arrow shown in FIG. 3 by the stopper pin 11 engaged with the needle-threading-shaft rotating cam 23, and the needle-threading hook 31 is inserted through the needle hole 2L in the needle 1L, as shown in FIG. 6(*b*).

In this case, the stopper pin 11 is retained at the lower end of the stopper slot 7 of the needle-threading stopper 6, and the needle-threading hook 31 is maintained in the inserted state in the needle hole 2L.

Subsequently, the thread TL is manually hooked to the needle-threading hook 31 in the inserted state, and the knob 24 of the control lever 20 is lifted and restored, so that after the needle-threading hook 31 still holding the thread TL ascends while receding from the needle hole 2L, the thread TL is removed from the needle-threading hook 31, whereby the needle-threading can be completed.

The mechanism that involves lowering the needle-threading shaft 10 by operating the control lever 20, subsequently inserting the needle-threading hook 31 through the needle hole 2 of the needle 1 by rotating the needle-threading shaft 10, and maintaining this state is disclosed in detail in Japanese Unexamined Patent Application Publication No. 2011-240051.

Subsequently, when the switch lever 41 is manually operated rightward so as to be set at the indicated position "M", the left end of the positioning body 50 moves away from the L adjustment pin 46 and slides rightward along the line S, as shown in FIG. 5(*b*). The middle notch 53 of the switch cam 52 engages with the switch spring 44 provided at the sliding body 40, and the reference pin 13 comes into slidably contact with the M surface 54*b* of the slot cam 54, whereby the slide position of the positioning body 50 is defined such that the needle-threading hook 31 corresponds to the position (M position) of the needle hole 2M in the needle 1M.

In this case, when the slide position of the positioning body 50 is switched from the L position to the M position by the switch lever 41, the cam surface shape of the slot cam 54 in slidably contact with the reference pin 13 switches from the L surface to the M surface, and the position of the needle-threading end section 30 relative to the needle-threading shaft 10 changes by a predetermined difference δ according to the cam surface shape.

Specifically, with regard to the needle-threading end section 30, the vertical position of the reference pin 13 relative to the sliding body 40 changes in accordance with the cam surface shape of the slot cam 54 in conjunction with the sliding of the positioning body 50 relative to the sliding body 40, and this change causes the vertical positional difference δ to occur between the needle-threading end section 30 and the needle-threading shaft 10.

Subsequently, similar to the threading through the needle hole 2L in the needle 1L, the knob 24 of the control lever 20 is operated, so that the threading of the thread TM through the needle hole 2M in the needle 1M can be completed.

Finally, when the switch lever 41 is manually operated further rightward so as to be set at the indicated position "R", the positioning body 50 slides rightward along the line S so that the right end comes into abutment with the R adjustment pin 47, as shown in FIG. 5(*c*). The left notch 53 of the switch cam 52 engages with the switch spring 44 provided at the sliding body 40, and the reference pin 13 comes into slidably contact with the R surface 54*c* of the slot cam 54, whereby the slide position of the positioning body 50 is defined such that the needle-threading hook 31 corresponds to the position (R position) of the needle hole 2R in the needle 1R.

In this case, when the slide position of the positioning body 50 is switched from the M position to the R position by the switch lever 41, the cam surface shape of the slot cam 54 in slidably contact with the reference pin 13 switches from the M surface to the R surface, and the position of the needle-threading end section 30 relative to the needle-threading shaft 10 returns to the same position as the L position.

Subsequently, by pressing down the knob 24 of the control lever 20 similarly as before, the threading of the thread TR through the needle hole 2R in the needle 1R can be completed.

Accordingly, the movement of the positioning body 50 along the line S relative to the sliding body 40 and the displacement according to the cam surface shape of the slot cam 54 are combined with each other, so that the needle-threading hook 31 can be moved along an arbitrary trajectory extending through the needle holes 2L, 2M, and 2R.

In other words, even if multiple vertical positions between the needle driving device A and the needle-threading device B are not defined by the stopper pin 11, similar advantages can be achieved with a simple structure, and the convenience and reliability of the needle-threading process as well as the size reduction of the needle-threading device B in the sewing machine N can be simultaneously achieved.

As described above, with regard to the needle-threading device B according to this embodiment, the needle-threading end section 30 is lowered by manually operating the control lever 20, the needle-threading hook 31 is inserted through the needle hole 2 in each needle 1, the thread T is subsequently hooked to the manually-inserted needle-threading hook 31, and the control lever 20 is lifted and restored, so that after the needle-threading hook 31 recedes from the needle hole 2 while still holding the thread T, the thread T is removed from the needle-threading hook 31, whereby the needle-threading can be completed.

Then, the switch lever 41 is manually operated, so that the positioning body 50 provided with the needle-threading hook 31 moves relative to the sliding body 40 by arbitrary amounts in the left-right direction and the up-down direction, thereby allowing for threading through the needle hole 2 in each needle 1 even in the sewing machine N having attached thereto the three needles 1 at different height positions.

Although the control lever 20 and the switch lever 41 are manually operated in the needle-threading device B according to this embodiment, the levers may be electrically driven by providing, for example, an additional motor or a solenoid.

Although the slide angle θ of the positioning body 50 in the needle-threading device B according to this embodiment is an angle between the line S connecting the needle hole 2L and the needle hole 2R to each other and the horizontal line, for example, the slide angle θ may be an angle formed with a line not extending through the needle hole 2R.

INDUSTRIAL APPLICABILITY

In the needle-threading device, the switch lever is manually operated, so that the needle-threading hook provided at the needle-threading end section of the needle-threading device moves relative to the needle-threading shaft by arbitrary amounts in the left-right direction and the up-down direction. Thus, the present invention is advantageous particularly as a needle-threading device used in a sewing machine equipped with multiple needles at different height positions.

REFERENCE SIGNS LIST

A needle driving device
B needle-threading device
D pitch (distance)
E circular arc
K, KL, KM, KR thread spool
N sewing machine
O center
S line
T, TL, TM, TR thread
h1, h2 height
δ difference
θ angle
1, 1L, 1M, 1R needle

2, 2L, 2M, 2R needle hole
3 needle clamp
4 needle bar
5 needle-bar connecting bracket
6 needle-threading stopper
7 stopper slot
10 needle-threading shaft
11 stopper pin
12 needle-threading return spring
13 reference pin (interlocking mechanism)
15 needle-threading-shaft support plate
16 rear surface plate
17 needle-threading-shaft slot
18 upper bearing
19 lower bearing
20 control lever
21 support-plate slide hole
22 shaft hole
23 needle-threading-shaft rotating cam
24 knob
30 needle-threading end section
31 needle-threading hook
32 E-shaped snap ring
33 pressure spring
40 sliding body
41 switch lever
42 fulcrum pin
43 action pin
44 switch spring
45 reference-pin slide long hole
46 L adjustment pin (eccentric pin)
47 R adjustment pin (eccentric pin)
50 positioning body
51 action-pin slide long hole
52 switch cam
53 notch
54 slot cam (interlocking mechanism)
54*a* L surface
54*b* M surface
54*c* R surface
55 hook arm

The invention claimed is:

1. A needle-threading device for a sewing machine, the needle-threading device comprising:

a needle-threading shaft that is parallel to a vertically-moving needle bar and that is vertically movable and rotatable;

a control lever that lowers and rotates the needle-threading shaft;

a needle-threading end section provided at a lower end of the needle-threading shaft and having a needle-threading hook; and a needle-threading stopper provided at the needle bar and defining a lowered stoppage position of the needle-threading shaft, wherein the needle-threading end section lowered by operating the control lever rotates at the lowered stoppage position and causes the needle-threading hook to be inserted through a needle hole of one needle of a plurality of needles provided at the needle bar, wherein the needle-threading end section includes a sliding body that vertically moves relative to the needle-threading shaft, a positioning body slidable relative to the sliding body, and an interlocking mechanism that vertically moves the sliding body relative to the needle-threading shaft in accordance with sliding of the positioning body, and wherein the interlocking mechanism includes a reference pin provided at the needle-threading shaft and a slot cam that is provided in the positioning body and with which the reference pin is in slidably contact, the slot cam having at least three stepped cam surfaces corresponding to at least three different heights of needle holes respectively in the plurality of needles.

2. The needle-threading device for the sewing machine according to claim 1, wherein the sliding body includes a switch lever that defines a slide position of the positioning body and a switch spring that retains the slide position of the positioning body by the switch lever, and wherein the positioning body includes a switch cam having a notch that engages with the switch spring.

3. The needle-threading device for the sewing machine according to claim 2, wherein the sliding body includes an eccentric pin that adjusts a sliding distance of the positioning body.

4. The sewing machine comprising the needle-threading device according to claim 1, wherein the sliding body includes an eccentric pin that adjusts a sliding distance of the positioning body.

5. The needle-threading device for the sewing machine according to claim 1, wherein each of the stepped cam surfaces are at different distances from each other vertically and horizontally.

6. The needle-threading device for the sewing machine according to claim 5, wherein the sliding body includes a switch lever that defines a slide position of the positioning body and a switch spring that retains the slide position of the positioning body by the switch lever, and wherein the positioning body includes a switch cam having notches that engage with the switch spring, each of the notches respectively corresponding to each of the stepped cam surfaces.

7. The needle-threading device for the sewing machine according to claim 6, wherein each of the notches are at different pitches from each other.

8. A sewing machine comprising the needle-threading device according to claim 1.

9. A sewing machine comprising the needle-threading device according to claim 2.

10. A sewing machine comprising the needle-threading device according to claim 4.

11. A sewing machine comprising the needle-threading device according to claim 3.

* * * * *